United States Patent [19]

Hughes

[11] Patent Number: 4,823,865

[45] Date of Patent: Apr. 25, 1989

[54] TURBULATOR CONSTRUCTION FOR A HEAT EXCHANGER

[75] Inventor: Dennis R. Hughes, Germantown, Wis.

[73] Assignee: A. O. Smith Corporation, Milwaukee, Wis.

[21] Appl. No.: 157,291

[22] Filed: Feb. 18, 1988

[51] Int. Cl.[4] ..... F28F 1/40; F28F 13/12

[52] U.S. Cl. ..... 165/109.1; 138/38

[58] Field of Search ..... 138/38; 165/109.1

[56] References Cited

U.S. PATENT DOCUMENTS

| | | | |
|---|---|---|---|
| 1,540,535 | 6/1925 | Burke | 138/38 |
| 2,660,198 | 11/1953 | Morrow | 138/38 |
| 2,677,394 | 5/1954 | Brinen et al. | 138/38 |
| 3,235,003 | 2/1966 | Smith | 138/38 |
| 3,269,420 | 8/1966 | Woodling | 138/38 |
| 3,457,982 | 7/1969 | Sephton | 138/38 |
| 3,492,972 | 2/1970 | McLaren | 138/38 |
| 3,582,045 | 6/1971 | Leybourne | 138/38 |
| 4,378,640 | 4/1983 | Buchholz | 138/38 |
| 4,559,998 | 12/1985 | Counterman | 138/38 |
| 4,577,681 | 3/1986 | Hughes | 138/38 |

FOREIGN PATENT DOCUMENTS

| | | | |
|---|---|---|---|
| 207757 | 3/1984 | Fed. Rep. of Germany | 165/109.1 |
| 2235344 | 1/1975 | France | 138/38 |

*Primary Examiner*—Samuel Scott
*Assistant Examiner*—Allen J. Flanigan
*Attorney, Agent, or Firm*—Andrus, Sceales, Starke & Sawall

[57] ABSTRACT

A turbulator construction for a heat exchanger. The turbulator is fabricated from a single sheet of flat metal which is bent in the form of a double helix. When disposed in a heat exchanger tube, the turbulator defines a pair of helical passages. The upstream end of the turbulator is flat and extends diametrically across the tube to divide the tube into a pair of inlet passages of substantially equal area. Each inlet passage communicates with one of the helical passages. In one form of the invention, the turbulator is formed from an elongated rectangular sheet of metal and in the bent condition, the peripheral edges of the helix are spaced from the tube to provide gaps therebetween. In a second form of the invention, the helix is formed from an elongated sheet with the side edges formed of a series of interconnected convex edge portions. In the bent condition, the curved edge portions conform to the inner surface of the tube, so that there is no appreciable gap between the helix and the tube.

12 Claims, 2 Drawing Sheets

TURBULATOR CONSTRUCTION FOR A HEAT EXCHANGER

BACKGROUND OF THE INVENTION

Turbulators or baffles are frequently used in heat exchanger tubes to increase the efficiency of the heat transfer. The turbulator acts to create turbulence and mixing within the heat exchanger tube, thereby increasing the rate of heat transfer. In a combustion system, efficient heat transfer results in condensation of water vapor. As condensation is a heat generating process, the heat produced through condensation can be utilized to further increase the efficiency of the heat transfer operation.

In the past, various forms of turbulators or baffles have been utilized in heat exchanger tubes. The turbulators should not only increase turbulence, but they should not produce undesirable back pressure and may be required to withstand severe environmental conditions. During service, the turbulators may be exposed to extreme elevated temperatures, as well as to acidic condensate.

In a conventional gas-fired water heater, the gas burner is located beneath the lower head of the tank and waste gases of combustion from the burner pass upwardly through one or more flues that extend through the tank. With this construction, heat is transferred from the burner through the lower head to the water in the tank, as well as from the waste gases passing through the flue to the water.

To increase the rate of heat transfer from the gases of combustion to the water, a baffle or turbulator is normally mounted within the flue. Various contours and configurations of turbulators have been employed with a water heater and a common turbulator is fabricated from a sheet of metal, which is twisted into the form of a helix.

SUMMARY OF THE INVENTION

The invention relates, in general, to a heat exchanger having improved efficiency and in particular to a turbulator construction for a heat exchanger tube. The invention has specific application to a turbulator for us in a flue in a gas-fired water heater.

In accordance with the invention, the turbulator is formed from a single sheet of flat metal, which is bent in the form of a double helix. When installed in the heat exchanger tube, the turbulator defines a pair of helical passages that extend the length of the tube.

The upstream end of the turbulator is generally flat and extends diametrically across the tube to divide the tube in a pair of inlet passages of substantially equal cross-sectional area. Each inlet passage communicates with one of the helical passages.

In one form of the invention, the turbulator is formed from an elongated rectangular sheet of metal having straight, generally parallel, side edges. In the flat form, the sheet includes a plurality of bend lines each being disposed at an acute angle with respect to adjacent bend lines. In the bent condition, the turbulator consists of a series of generally triangular sections with two sides of each section being connected to adjacent sections and the third side of each section being spaced from the inner surface of the tube to provide a gap therebetween.

In the second form of the invention, the side edges of the flat sheet, instead of being straight, are formed with a plurality of scallops or outwardly curved edge portions. In the bent form, the curved edge portion of each triangular section conforms to the inner surface of the tube, so that there is no appreciable gap between the turbulator and the tube.

The turbulator of the invention is of simple and inexpensive construction, being formed of a single sheet of metal and bent into a double helix configuration.

The turbulator provides turbulence for the fluid flowing within the heat exchanger tube to increase the efficiency of heat transfer, yet provides a minimum pressure drop or restriction.

By varying the angle of bending throughout the length of the turbulator, the pitch of the double helix can be correspondingly varied in order to achieve the desired pressure drop and fluid flow.

While the turbulator has seen particular application for use in a water heater, the turbulator can be used in various types of heat exchangers for transferring heat between two fluids.

Other objects and advantages will appear in the course of the following description.

DESCRIPTION OF THE DRAWINGS

The drawings illustrate the best mode presently contemplated for carrying out the invention.

In the drawings.

DESCRIPTION OF THE ILLUSTRATED EMBODIMENT

Figure 1:
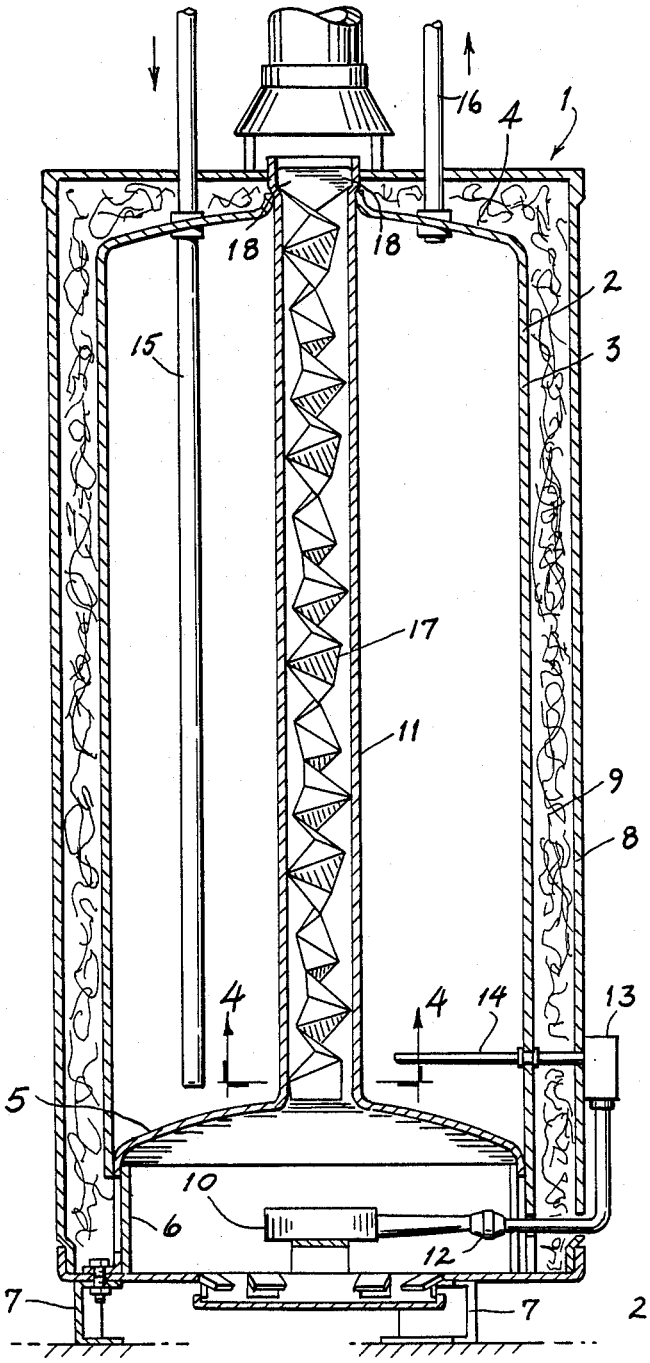
FIG. 1 is a vertical section of a conventional gas-fired water heater construction having a flue containing the turbulator construction of the invention.

FIG. 1 shows a conventional gas fired water heater 1, which is composed of a tank 2 to contain water to be heated. Tank 2 includes a generally cylindrical shell 3, which is enclosed at its upper end by an upper head 4 and at its lower end by a lower head 5. A skirt 6 is attached to the lower head and carries a series of legs 7 which act to support the water heater from the ground or other foundation.

In practice, an outer jacket 8 is spaced outward from tank 2 and a layer of insulating material 9, such as fiber glass or foamed resin, is located in the space between the tank and the outer jacket.

The water in tank 2 is heated by a burner 10 which is located beneath lower head 5 and the waste products of combustion are discharged upwardly from the burner to a central flue 11, which is secured within aligned openings in lower head 5 and upper head 4.

Gas is supplied to burner 10 through a gas line 12 and the flow of gas in line 10 is controlled by a valve 13, which is operated by a thermostat 14, that is responsive to the temperature of the water in tank 2.

Water is introduced into the tank through a dip tube 15 and is withdrawn through an outlet 16 in upper head 4.

As previously noted, the water heater 1, as illustrated, is of conventional design and in itself forms no part of the present invention.

In accordance with the invention, a baffle or turbulator 17 is mounted within flue 11. The upper end of turbulator 17 is provided with a pair of laterally extending ears 18, which are received within slots in the upper end of flue 11 to suspend the turbulator within the flue.

Figure 2:
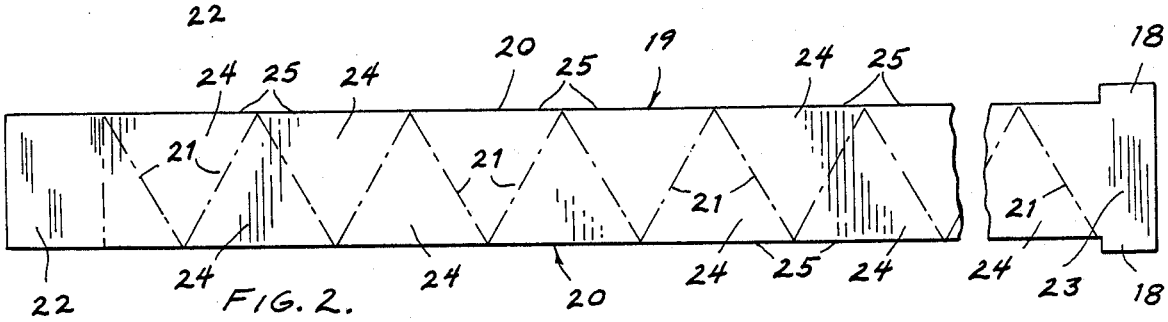
FIG. 2 is a plan view of a flat sheet of metal to be bent into the turbulator.

Turbulator 17 is fabricated from an elongated generally rectangular sheet 19 of metal, as illustrated in FIG. 2. Sheet 19 has a pair of straight parallel side edges 20 and extending between side edges 20 are a plurality of bend or fold lines 21, along which the sheet is bent. As illustrated in FIG. 2, the bend lines 21 are disposed at an acute angle, preferably about 60° to side edges 20.

The bend lines 21 terminate short of the end edges of the sheet to provide a pair of end sections 22 and 23. Ears 18 extend outwardly from section 23.

Figure 3:
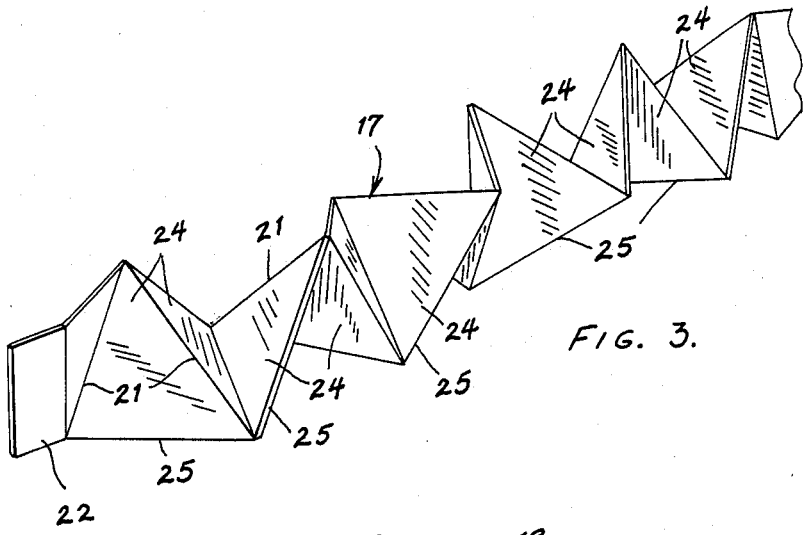
FIG. 3 is a perspective view of the turbulator bent from the sheet shown in FIG. 2.

Sheet 18 is bent along the bend lines 21 to produce turbulator 17, which takes the form of a double helix, as best illustrated in FIG. 3. In the bent form, the turbulator is composed of a plurality of generally equilateral triangular sections 24, two sides of each section being connected to adjacent triangular sections and the third side 25 of each triangular being exposed and spaced from the inner surface of flue 11 to provide a gap 26 therebetween.

Figure 4:
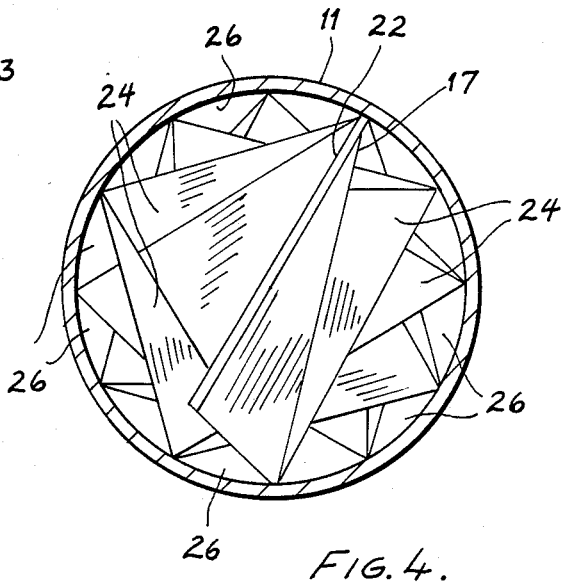
FIG. 4 is a section taken along line 4—4 of FIG. 1 and showing the flue containing the turbulator.

In the bent condition, the end 22 is located at the lower end of flue 11 and, as shown in FIG. 4, extends diametrically across the flue and divides the flue into a pair of inlet passages of substantially equal cross-sectional area. The turbulator 17, in combination with flue 11, defines a pair of helical passages and each inlet passage communicates with the lower end of one of the helical passages. With the divider section 22, substantially equal flow will be obtained in the two helical passages.

In operation, the waste gases of combustion from the burner can flow upwardly through the two helical passages, as well as flowing upwardly along the inner surface of the flue due to the gaps 26. The triangular sections 24 direct the flow away from the center of the flue and provide a bypass of the gases through gaps 26 and over the helix, reducing the pressure drop.

Figure 6:
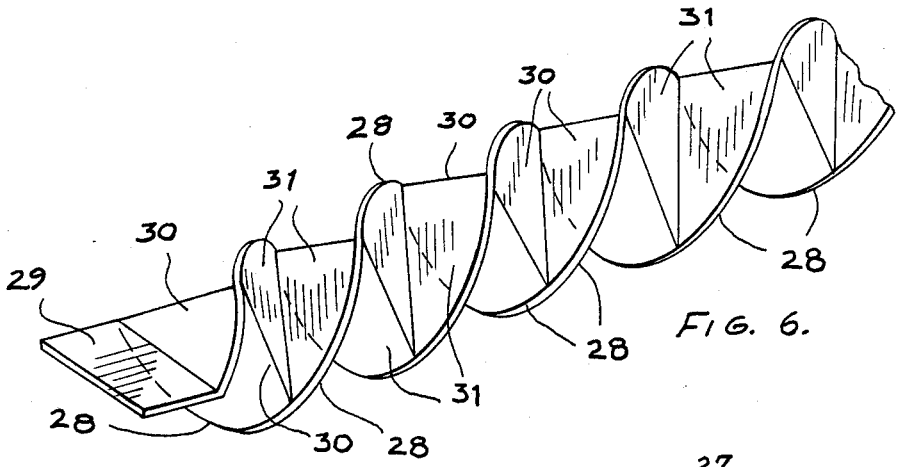
FIG. 6 is a perspective view of the turbulator formed from the sheet shown in FIG. 6.
Figure 5:
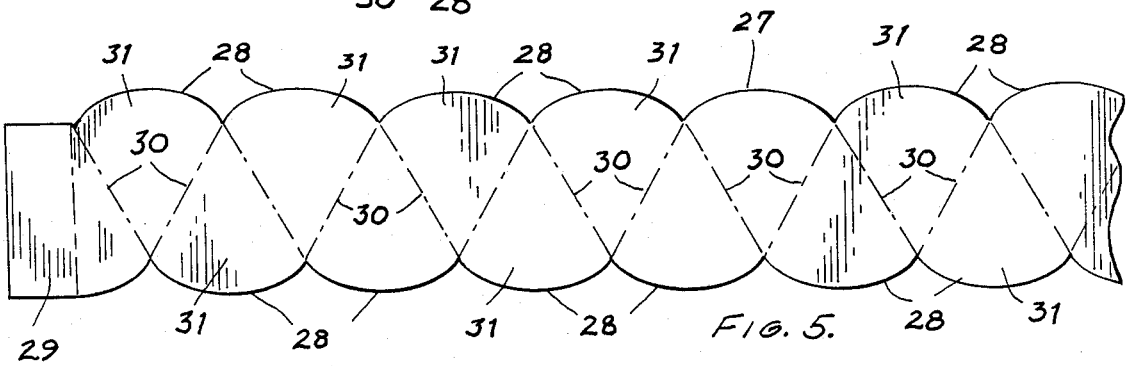
FIG. 5 is a plan view of a metal sheet to be employed to produce a modified form of the turbulator.

FIGS. 5 and 6 illustrate a modified form of the turbulator, in which the turbulator is bent from an elongated metal sheet 27. As shown in FIG. 5, the elongated sides of sheet 27 are formed of a series of convex or outwardly curved edge portions 28. The curved edge portions 28 terminate short of the ends of sheet 27 to provide a pair of generally rectangular end sections, only one of which is shown in FIG. 5 and indicated by 29. Curved edge portions 28, as best seen in FIG. 5, do not have a constant radius, but instead are generally elliptical in curvature.

As in the case of the first embodiment, a plurality of bend lines 30 extend transversely across sheet 27 and are disposed at an acute angle, preferably 60°, with respect to each other.

When sheet 27 is bent in alternate directions along bend lines 30, a double helix is provided, in which the turbulator is composed of a plurality of generally triangular sections 31. Two sides of each triangular section 31 are connected to sides of adjacent triangular sections, while the curved exposed edge portion 28 of each section 31 conforms generally to the inner surface of flue 11, so that there is no appreciable gap between the turbulator and the flue, as illustrated in FIG. 7.

End section 29 extends diametrically across flue 11 to provide a pair of inlet passages of substantially equal cross sectional area and each inlet passage communicates with one of the helical passages defined by the turbulator and the flue 11.

Figure 7:
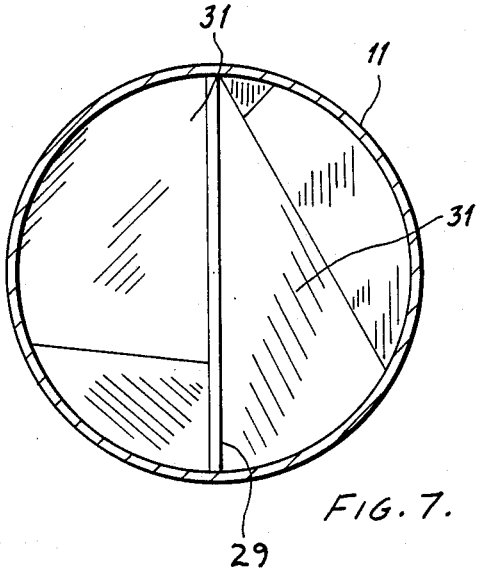
FIG. 7 is a transverse section showing the turbulator of FIG. 6 mounted within a heat exchange tube.

With the construction shown in FIGS. 5–7, the waste gases will be directed upwardly through the two helical passages and the end section 29 acts to divide the flow between the two helical passages.

By varying the angularity of bend lines 21 and 30 over the entire length of the turbulator, or portions thereof, and correspondingly adjusting the contour of the edge in the flat, the pitch of the double helix can correspondingly be varied to obtain the desired pattern of fluid flow and pressure drop in the turbulator.

The invention provides a simple and inexpensive manner of providing a baffle or turbulator for a heat exchanger tube, which can be bent from a single elongated sheet of metal. The flat sheet, as shown in FIGS. 5 and 6, can have side edges with curved or elliptical portions, so that the side edges of the bent turbulator conform to the inner surface of the flue or heat exchanger tube. Alternately, as shown in FIGS. 2 and 3, the side edges of the sheet can be straight or the side edges can be formed with a series of convex scallops, or formed with serrations or formed with any other desired contour to provide gaps between the peripheral edges of the turbulator and the heat exchanger tube. The turbulator can be formed of any heat-resistant bendable material, or alternately, the turbulator can be cast in the resultant configuration.

While the turbulator of the invention has application for use with a flue in a gas-fired water heater, it is contemplated that the turbulator can be used in a wide variety of heat exchangers for transferring heat between two fluids. In addition, while the turbulator, as shown in the drawings, is mounted in a vertical orientation, it is contemplated that the turbulator can be mounted horizontally or in any other orientation.

Various modes of carrying out the invention are contemplated as being within the scope of the following claims particulary pointing out and distinctly claiming the subject matter which is regarded as the invention.

I claim:

1. A heat exchanger, comprising a tube to conduct a fluid in a downstream direction, a turbulator disposed within the tube and disposed in the form of a double helix, said turbulator in combination with said tube defining a pair of helical passages, the upstream end of said turbulator being generally flat and extending generally diametrically across the tube to divide the tube into a pair of inlet passages, each inlet passage communicating with one of said helical passages, said turbulator being composed of a plurality of triangular sections, each triangular section having three side edges and each section disposed at an angle with respect to adjacent sections, a pair of said side edges of each section being connected to side edges of adjacent sections and each section having a third exposed side edge facing the inner surface of said tube.

2. The heat exchanger of claim 1, wherein said inlet passages have substantially equal cross sectional areas.

3. The heat exchanger of claim 1, wherein the third side of each section is spaced from the inner surface of said tube to provide a gap therebetween.

4. A heat exchanger, comprising a generally cylindrical tube to conduct a fluid in a downstream direction, a turbulator disposed within the tube, said turbulator being composed of a single sheet of flat metal having continuous uninterrupted opposed sides and bent in the form of a double helix, said turbulator in combination with said tube defining a pair of generally helical passages that extend the length of said turbulator, said turbulator including a plurality of generally flat triangular sections disposed at an acute angle with respect to adjacent sections, each section having three side edges, a pair of said side edges of each section being connected to side edges of adjacent sections and each section having a third exposed side edge facing said tube.

5. The heat exchanger of claim 4, wherein the third side of each section is spaced from the inner surface of said tube to provide a gap therebetween.

6. A heat exchanger, comprising a generally cylindrical tube to conduct a fluid in a downstream direction, a turbulator disposed within the tube and composed of a single sheet of flat metal bent in the form of a double helix, said turbulator in combination with said tube defining a pair of generally helical passages, said sheet in flat form including a plurality of bend lines with each bend line disposed at an acute angle with respect to adjacent bend lines, said sheet being bent alternately along said bend lines to provide a plurality of generally flat triangular interconnected sections, said sections disposed at an acute angle to each other, a pair of said side edges of each section being connected to said edges of adjacent sections along said bend lines, each section having a third side edge facing said tube, said sections being substantially identical in size and shape.

7. The heat exchanger of claim 6, wherein said bend lines are disposed at an angle of about 60° with respect to each other.

8. The heat exchanger of claim 6, wherein said sheet in flat form is generally rectangular in shape having a pair of parallel elongated side edges connected by a pair of end edges, said bend lines extending between said side edges and located at an acute angle with respect to said side edges.

9. The heat exchanger of claim 6, wherein said sheet in flat form has a pair of elongated side edges connected by a pair of end edges, each side edge composed of a series of outwardly curved edge portions, with each edge portion joining adjacent edge portions at a juncture, said bend lines extending from a juncture at one side edge to a juncture at the opposite side edge.

10. The heat exchanger of claim 9, wherein said curved edge portions have a varying radius of curvature.

11. A heat exchanger, comprising a tube to conduct a fluid in a downstream direction, a turbulator disposed within the tube and disposed in the form of a double helix, said turbulator in combination with said tube defining a pair of helical passages, the upstream end of said turbulator being generally flat and extending generally diametrically across the tube to divide the tube into a pair of inlet passages, each inlet passage communicating with one of said helical passages, said turbulator being composed of a plurality of generally triangular sections, each triangular section disposed at an angle with respect to adjacent sections, each section having a pair of sides connected to the sides of adjacent sections with each section having a third exposed side facing the inner surface of said tube, said third side being generally convex and conforming to the curvature of the inner surface of said tube.

12. A heat exchanger, comprising a generally cylindrical tube to conduct a fluid in a downstream direction, a turbulator disposed within the tube, said turbulator being composed of a single sheet of flat metal bent in the form of a double helix, said turbulator in combination with said tube defining a pair of generally helical passages that extend the length of said turbulator, said turbulator including a plurality of generally triangular sections disposed at an acute angle with respect to adjacent sections, each section having a pair of sides connected to sides of adjacent sections and each section having a third exposed side facing said tube, said third side of each section being curved outwardly and conforming generally to the configuration of the inner surface of said tube.

* * * * *

UNITED STATES PATENT AND TRADEMARK OFFICE

CERTIFICATE OF CORRECTION

PATENT NO. : 4,823,865

DATED : April 25, 1989

INVENTOR(S) : DENNIS R. HUGHES

It is certified that error appears in the above-identified patent and that said Letters Patent is hereby corrected as shown below:

Col. 5, Line 31, CLAIM 6 Delete "said" and substitute therefor ---side---

Signed and Sealed this

Eleventh Day of December, 1990

*Attest:*

HARRY F. MANBECK, JR.

*Attesting Officer*

*Commissioner of Patents and Trademarks*